US005730159A

United States Patent [19]

Draghetti et al.

[11] Patent Number: 5,730,159

[45] Date of Patent: Mar. 24, 1998

[54] UNIT FOR SUPPLYING LAYERS OF CIGARETTES

[75] Inventors: Fiorenzo Draghetti, Medicina; Fulvio Boldrini, Ferrara, both of Italy

[73] Assignee: G.D Societa' Per Azioni, Italy

[21] Appl. No.: 764,853

[22] Filed: Dec. 13, 1996

[30] Foreign Application Priority Data

Dec. 14, 1995 [IT] Italy ..... BO95A0589

[51] Int. Cl.[6] ..... A24C 1/14

[52] U.S. Cl. ..... 131/282; 131/283; 53/149; 53/151

[58] Field of Search ..... 53/151, 150, 149, 53/148, 444; 131/282, 283, 285

[56] References Cited

U.S. PATENT DOCUMENTS 5,070,991 12/1991 Hinchcliffe et al. ..... 198/418.3

FOREIGN PATENT DOCUMENTS 2098971 5/1982 United Kingdom ..... 131/84.4

*Primary Examiner*—Vincent Millin
*Assistant Examiner*—Charles W. Anderson
*Attorney, Agent, or Firm*—Klauber & Jackson

[57] ABSTRACT

A unit for supplying layers of cigarettes, wherein a supply outlet, presenting an open bottom end and a number of channels converging towards the bottom end, feeds a succession of layers of cigarettes along the channels to the bottom end; and an extracting device is associated with the outlet to expel the layers one by one in an extraction direction parallel to the cigarettes in the layer and on to a fixed pickup plate presenting a bottom surface for releasably retaining the cigarettes in a single layer.

11 Claims, 3 Drawing Sheets

UNIT FOR SUPPLYING LAYERS OF CIGARETTES

BACKGROUND OF THE INVENTION

The present invention relates to a unit for supplying layers of cigarettes.

As described, for example, in British Patent n. 2,207,409, one known unit for supplying layers of cigarettes comprises a supply outlet presenting an open bottom end and a given number of channels parallel to one another at least at the bottom end; and the outlet feeds along the channels to the bottom end successive layers of cigarettes, equally spaced within the layers, and each forming a layer of a packet of cigarettes.

The above known supply unit also comprises a fixed supporting plate to the side of the bottom end; and an extracting device associated with the supply outlet, and which presents a push element movable in relation to the bottom end to expel each layer through the bottom end in a direction parallel to the cigarettes in the layer and on to the supporting plate.

Again according to the above British patent, the supply unit also comprises a transfer device associated with the supporting plate to transfer the extracted layer to a pickup station, and which in turn comprises a compacting element movable over the supporting plate and crosswise to the extraction direction to compact the cigarettes in each extracted layer prior to transferring them to the pickup station.

In recent times, the increase in the output speed of packets of cigarettes has brought about a corresponding increase in the speed with which the layers are extracted from the supply outlet, and hence difficulty in handling the cigarettes in each extracted layer. In other words, the problem now arises of rapidly extracting the layers of cigarettes from the supply outlet and providing for smooth handling of the cigarettes in each layer.

One possible solution to the problem is a supply unit of the type described in British Patent n. 2,098,971, which presents an extracting device for extracting from the supply outlet a number of cigarettes closely arranged into a row; and a supporting plate movable between a receiving position, in which it receives the row of cigarettes from the extracting device, and an unloading position, in which it feeds the row of cigarettes to an intermediate conveyor. This is defined by a drum rotating about its axis, and presenting a number of peripheral suction seats for receiving and releasably retaining respective cigarettes in the row, and for feeding them along a given path.

The supply unit described in British patent n. 2,098,971 also comprises a cigarette layer forming device located downstream from the intermediate conveyor along said path, and which provides for receiving each row of cigarettes and extracting from it at least one layer of cigarettes.

Though it does in fact provide for smooth handling of the cigarettes, the above supply unit presents several drawbacks, mainly in terms of cost, and mainly due to the large number of component parts and hence complex design of the unit. Moreover, simultaneously extracting a large number of cigarettes may result in all of them being destroyed if even only one is positioned even only partly outside the respective suction seat on the intermediate conveyor.

SUMMARY OF THE INVENTION

It is an object of the present invention to provide a straightforward, low-cost unit for supplying layers of cigarettes, and which at the same time provides for overcoming the aforementioned drawbacks.

According to the present invention, there is provided a unit for supplying layers of cigarettes, each layer forming a layer of a packet of cigarettes, and the unit comprising a supply outlet presenting an open bottom end and for feeding a succession of said layers to said bottom end; an extracting device presenting a push element movable in relation to said bottom end to successively expel said layers from the bottom end in an extraction direction parallel to the cigarettes in said layers; a receiving plate located to the side of said bottom end to receive and releasably retain each extracted layer at a pickup station; and a pickup head movable along a given path, and which is arrested facing the plate to receive a single layer located at the pickup station; characterized in that said plate and said pickup station are fixed; the pickup station being defined by a bottom surface of the plate; and said path extending beneath the fixed pickup station.

According to a preferred embodiment of the above supply unit, said supply outlet comprises a number of partitions defining respective drop-down channels for respective columns of cigarettes; said channels converging towards, and at least at, said bottom end to compact the cigarettes in each layer.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
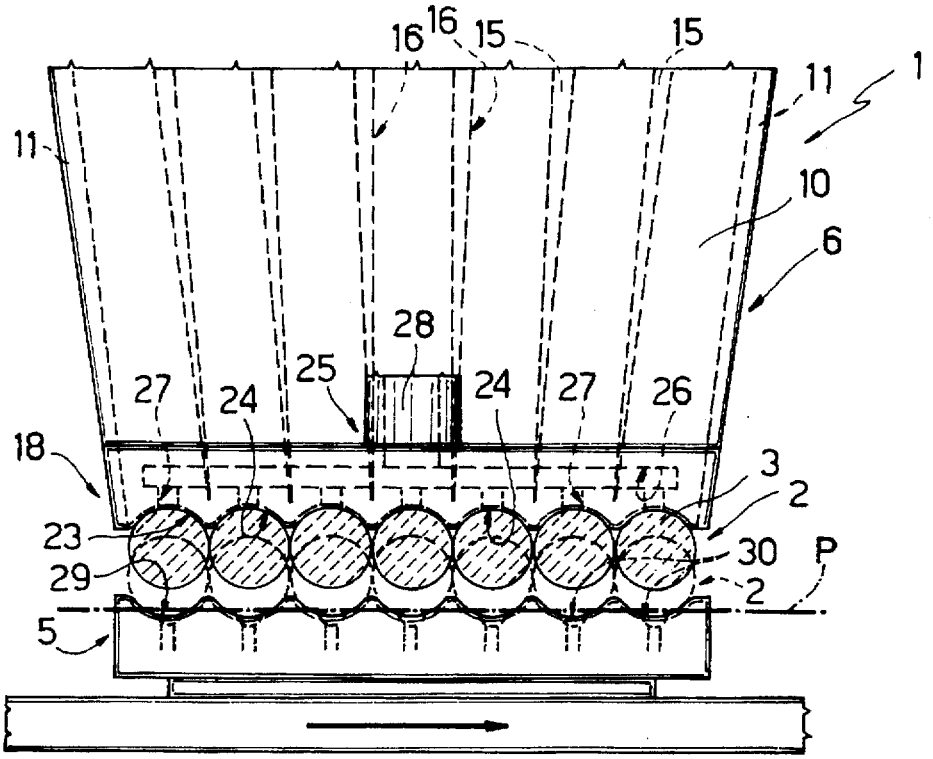
FIG. 1 shows a partly sectioned front view of a first preferred embodiment of the supply unit according to the present invention.
Figure 4:
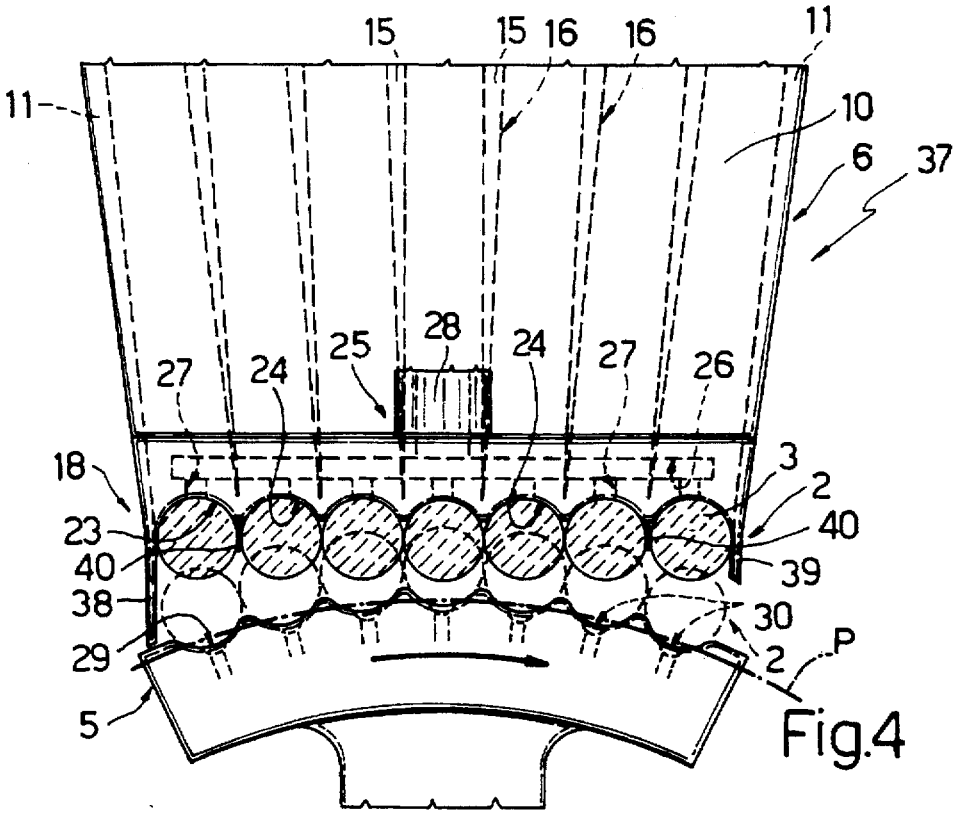
FIG. 4 shows a partly sectioned front view of a third preferred embodiment of the supply unit according to the present invention.
Figure 2:
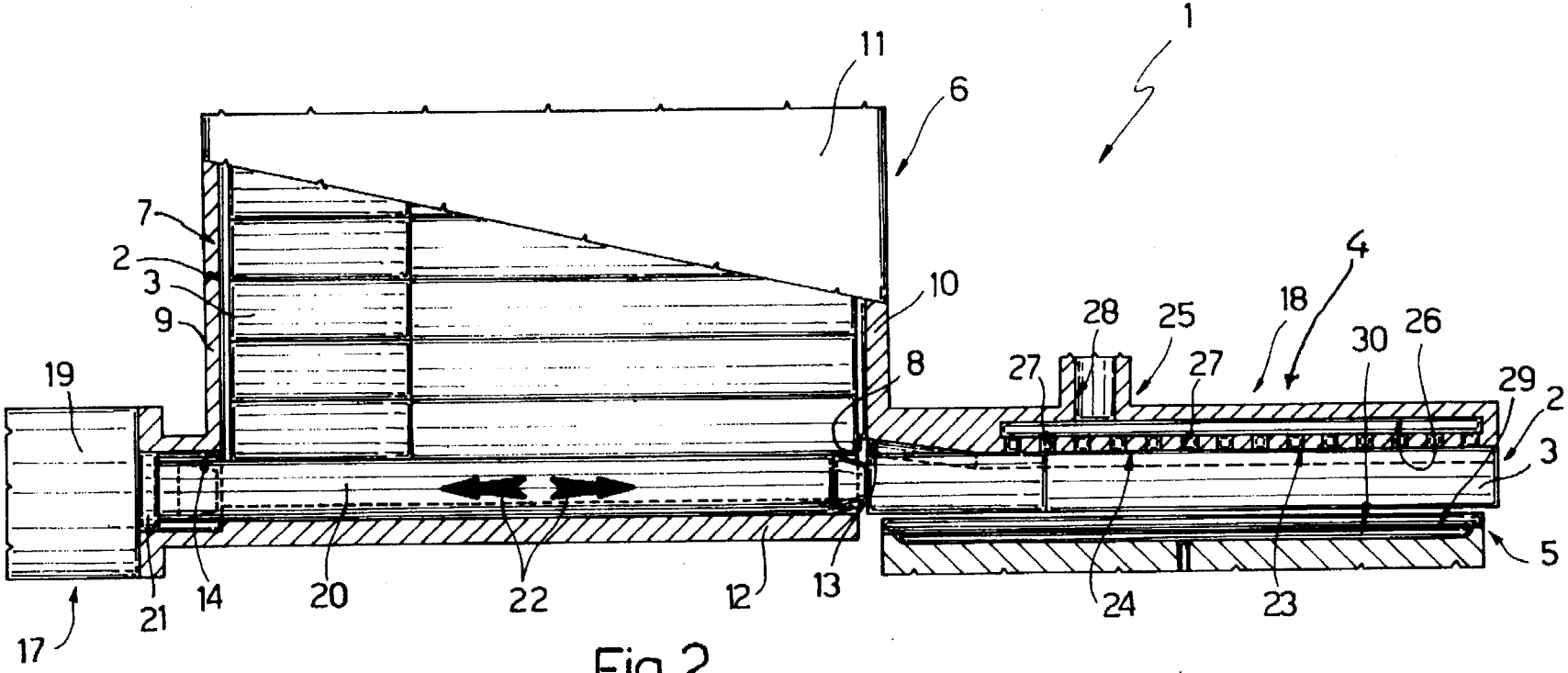
FIG. 2 shows a section of FIG. 1.
Figure 3:
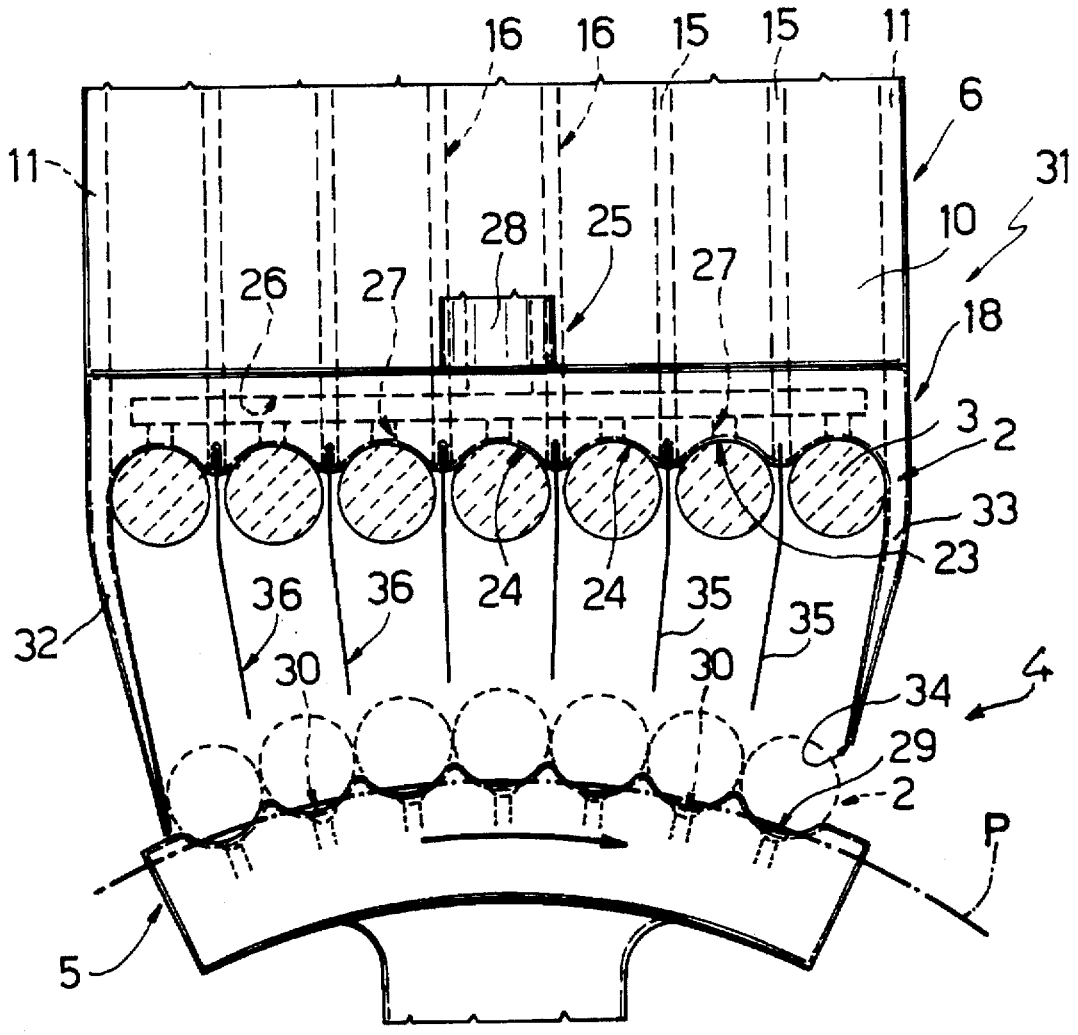
FIG. 3 shows a partly sectioned front view of a second preferred embodiment of the supply unit according to the present invention.

Number 1 in FIGS. 1 and 2 indicates a unit for supplying layers 2, each defined by a given number of cigarettes 3 and forming a layer 2 of a known packet of cigarettes (not shown). Unit 1 comprises a fixed pickup station 4 for single layers 2; and a receiving head 5, which is movable along a given path P extending, for example, substantially tangent to and beneath station 4, as shown in FIGS. 1, 3 and 4, and is arrested facing station 4 to receive a single layer 2 located at station 4.

Unit 1 comprises a supply outlet 6 for gravity feeding a succession 7 of layers 2 to a horizontal bottom opening 8, and in turn comprising two vertical end walls 9 and 10, and two lateral walls 11 crosswise to walls 9 and 10 and converging towards a horizontal bottom wall 12 located beneath opening 8. Wall 12 defines, with the bottom end of wall 10, a vertical open bottom end 13 of outlet 6, and, with the bottom end of wall 9, a vertical opening 14 facing and aligned with end 13 on the opposite side of end 13 to opening 8. Outlet 6 also comprises a number of substantially vertical partitions 15 located between walls 11 and crosswise to walls 9 and 10, and which converge towards end 13 and define respective drop-down channels 16 for respective columns of cigarettes 3 converging towards end 13.

Unit 1 also comprises an extracting device 17 located beneath opening 8 and to the front of opening 14, and for expelling single layers 2 of cigarettes 3 from outlet 6 through end 13; and a supporting plate 18 located above and to the side of end 13, and which provides for releasably retaining layer 2 expelled from outlet 6 by device 17.

Extracting device 17 comprises a linear actuator 19; and a push element 20 connected to the output rod 21 of actuator 19 and movable back and forth, in an extraction direction 22 parallel to the axes of cigarettes 3 in each layer 2, between an extracted position in which element 20 is located between opening 8 and wall 12 to feed the layer 2 resting on wall 12 underneath plate 18 and so detach layer 2 from the others in succession 7 and at the same time prevent the other layers 2 from dropping down on to wall 12, and a withdrawn position in which element 20 is located outside outlet 6 and to the front of opening 14 to enable the next layer 2 to drop down on to wall 12.

Plate 18 presents a bottom surface 23, which is located above and to the side of end 13, defines pickup station 4, and in turn presents a given number of substantially cylindrical grooves 24 closely arranged parallel to direction 22, aligned with respective channels 16, and for receiving and retaining respective cigarettes 3. More specifically, plate 18 comprises a retaining device 25 for releasably retaining cigarettes 3 inside respective grooves 24, and in turn comprising a suction chamber 26 inside plate 18, a number of holes 27 connecting chamber 26 to grooves 24 and formed through surface 23, and a pneumatic suction device 28 communicating with chamber 26.

It should be pointed out that path P may extend along any trajectory substantially perpendicular to the axes of cigarettes 3 and other than that shown in FIGS. 1, 3 and 4, and may, for example, at station 4, comprise a portion substantially perpendicular to the horizontal plane of plate 18.

In actual use, succession 7 of layers 2 is fed by gravity from outlet 6 to bottom wall 12, on which a layer 2 of closely contacting cigarettes 3 is formed; at which point, extracting device 17 activates linear actuator 19 to move push element 20 into the extracted position and so push the layer 2 resting on wall 12 through end 13 in direction 22 and beneath surface 23.

Simultaneously with layer 2 being fed into contact with surface 23, retaining device 25 is activated to retain each cigarette 3 in layer 2 inside respective groove 24 until a head 5 is arrested beneath pickup station 4. More specifically, head 5 is also a suction plate, and presents a flat upper surface 29 presenting as many grooves 30 as grooves 24, and for receiving layer 2 from plate 18.

The FIG. 3 embodiment relates to a supply unit 31 similar to unit 1, except that channels 16 of outlet 6 are parallel to one another and provide for gravity feeding a succession 7 of layers 2 in which cigarettes 3 are equally paced; grooves 24 are also equally spaced and aligned with respective channels 16; and plate 18 presents two lateral appendixes 32 and 33 extending downwards on either side of surface 23, and converging towards a bottom opening 34 beneath surface 23.

Plate 18 of unit 31 also presents a number of substantially vertical blades 35 located between and parallel to appendixes 32 and 33, and which converge towards opening 34 and define respective further drop-down channels 36 for respective cigarettes 3. Channels 36 converge towards opening 34 to compact the cigarettes 3 in each layer 2 as they drop from surface 23 towards opening 34.

Unit 31 operates in the same way as unit 1, except that cigarettes 3 in each layer 2 are compacted inside channels 36 as opposed to channels 16 of outlet 6. Moreover, surface 29 of head 5 for removing layer 2 through opening 34 may be either a flat surface, as shown in FIG. 1, in which case opening 34 is a flat horizontal opening (not shown), or a curved surface coaxial with an axis (not shown) parallel to direction 22, as shown in FIG. 3, in which case opening 34 is also substantially curved and coaxial with said axis (not shown). In both the above cases, however, path P of head 5 extends substantially tangent to opening 34.

The FIG. 4 embodiment relates to a supply unit 37 similar to unit 1, except that plate 18 presents two parallel lateral guide appendixes 38 and 39 extending downwards from and on either side of surface 23, and at least two blades 40 parallel to each other and to appendixes 38, 39, extending downwards from surface 23, and separated from respective appendixes 38, 39 by a distance substantially equal to the diameter of groove 24.

Appendixes 38 and 39, the first of which is longer than the second, and blades 40, which are shorter than the diameter of cigarette 3, provide for guiding the cigarettes 3 at the opposite ends of respective layer 2 as they drop from plate 18 on to head 5. This is made necessary on account of the curved surface 29 of head 5, which is positioned with a central portion substantially tangent to the bottom surface of layer 2 on surface 23, and with its end portions a given distance from said bottom surface, so that at least a small part of the fall of the end cigarettes 3 in layer 2 must be guided to prevent them from falling out of line in relation to the other cigarettes 3 in the same layer 2.

Operation of unit 37 may be deduced from that of unit 1, and therefore requires no further explanation.

Units 1, 31 and 37 therefore provide not only for supplying head 5 with a single layer 2 of mutually contacting cigarettes 3 with no need for movable compacting elements capable of damaging cigarettes 3, but also for forming a single layer 2 of cigarettes 3 relatively rapidly with no need for intermediate conveyors.

We claim:

1. A unit (1;31;37) for supplying layers (2) of cigarettes (3), each layer (2) being defined by a given number of cigarettes (3) and forming a layer (2) of a packet of cigarettes, said unit (1;31;37) comprising: a supply outlet (6) having an open bottom end (13) and for feeding a succession (7) of said layers (2) to said bottom end (13); an extracting device (17) comprising a push element (20) movable in relation to said bottom end (13) to successively expel said layers (2) from the bottom end (13) in an extraction direction (22) parallel to the cigarettes (3) in said layers (2); a fixed receiving plate (18) located to the side of said bottom end (13) to receive and releasably retain each extracted layer (2) on the underside of said receiving plate (18) at a fixed pickup station (4) defined by a bottom surface (23) of the plate (18), the plate(18) being provided with a retaining device (25) for releasably retaining the cigarettes (3) in a single layer (2) in contact with said bottom surface (23); and a pickup head (5) movable along a given path (P) extending beneath the fixed pickup station (4); the pickup head (5) being adapted to be arrested facing said bottom surface (23) to receive said single layer (2) located at the pickup station (4); and said retaining device (25) comprising a number of suction holes (27) formed through said bottom surface (23).

2. A unit according to claim 1 wherein said path (P) extends in a direction substantially crosswise to said extraction direction (22).

3. A unit according to claim 2 wherein said path (P) extends substantially tangent to said fixed pickup station (4).

4. A unit according to claim 2 wherein said path (P) comprises at least a portion extending in a direction substantially perpendicular to said fixed pickup station (4).

5. A unit according to claim 1 wherein said supply outlet (6) comprises a number of partitions (15) defining respective drop-down channels (16) for respective columns of cigarettes (3); said channels (16) converging towards, and at least at, said bottom end (13) to compact the cigarettes (3) in each layer (2).

6. A unit according to claim 5 wherein said bottom surface (23) has a given number of grooves (24) equal to said number of cigarettes (3) in each layer (2); said grooves (24) being parallel to said extraction direction (22), and each housing and releasably retaining, in use, a respective cigarette (3) of a respective said layer (2).

7. A unit according to claim 6 wherein said plate (18) comprises two vertical lateral walls (38, 39) extending downwards on either side of said bottom surface (23); and at least two vertical blades (40), each parallel to a respective lateral wall (38, 39) and located, in relation to the respective lateral wall (38, 39), on the opposite side of a groove (24) in said bottom surface (23).

8. A unit according to claim 6 wherein said plate (18) comprises two vertical lateral walls (32, 33); and a number of blades (35) extending downwards between said two lateral walls (32, 33) and from said bottom surface (23), and defining respective further drop-down channels (36) for respective cigarettes (3); said further channels (36) being aligned with respective said grooves (24) and converging towards a bottom opening (34) beneath said bottom surface (23).

9. A unit according to claim 6 wherein said path (P) extends substantially tangent to said bottom opening (34).

10. A unit according to claim 1 wherein said retaining device (25) further comprises a suction chamber (26) inside said plate (18); said chamber (26) communicating with said holes (27) and with a pneumatic suction device (28).

11. A unit according to claim 1 wherein said pickup head (5) is provided with a given number of grooves (30) equal to said given number of cigarettes (3) in each layer (2).

* * * * *